United States Patent [19]

Matsuzaki et al.

[11] Patent Number: 4,570,843

[45] Date of Patent: Feb. 18, 1986

[54] METHOD FOR MANUFACTURING ANODE CYLINDERS OF ELECTRON TUBES

[75] Inventors: Hikaru Matsuzaki, Yokohama; Toshiyuki Matsuzaki, Kawasaki, both of Japan

[73] Assignee: Tokyo Shibaura Denki Kabushiki Kaisha, Japan

[21] Appl. No.: 582,856

[22] Filed: Feb. 24, 1984

Related U.S. Application Data

[63] Continuation of Ser. No. 336,407, Dec. 31, 1981, abandoned.

[30] Foreign Application Priority Data

Jan. 14, 1981 [JP] Japan ..... 56-3111
Jan. 20, 1981 [JP] Japan ..... 56-6693
Jan. 20, 1981 [JP] Japan ..... 56-6696

[51] Int. Cl.[4] ..... B21C 37/08; B21C 37/22; B21D 22/28

[52] U.S. Cl. ..... 228/151; 72/348; 72/349; 72/368; 228/119; 228/191

[58] Field of Search ..... 228/151, 144, 156, 164, 228/119, 191; 72/51, 359, 347–349, 368, 384, 398, 370, 391, 343; 29/149.5 C, 149.5 DP, 149.5 R

[56] References Cited

U.S. PATENT DOCUMENTS

| | | | |
|---|---|---|---|
| 1,236,470 | 8/1917 | Neuberth | 72/348 |
| 1,274,359 | 7/1918 | Limont | 72/348 |
| 1,387,199 | 8/1921 | Small | 72/368 |
| 1,772,187 | 8/1930 | Manning | 29/149.5 R |
| 1,980,363 | 11/1934 | Staples | 72/368 |
| 2,014,605 | 9/1935 | Zimmerman et al. | 72/348 |
| 2,168,300 | 8/1939 | Lemming | 72/370 |
| 2,384,444 | 9/1945 | Cravener, Jr. et al. | 29/148.4 |
| 3,442,008 | 5/1969 | Johnson | 29/521 |
| 3,451,246 | 6/1969 | Miller et al. | 72/398 |
| 3,796,085 | 3/1974 | Fisher et al. | 72/348 |
| 3,930,396 | 1/1976 | Martinez | 72/347 |
| 3,945,231 | 3/1976 | Imazu et al. | 72/349 |

FOREIGN PATENT DOCUMENTS

| | | | |
|---|---|---|---|
| 2721029 | 11/1978 | Fed. Rep. of Germany . | |
| 1028421 | 5/1953 | France . | |
| 90464 | 10/1973 | Japan | 72/368 |
| 50-157854 | 12/1975 | Japan . | |
| 22477 | 2/1980 | Japan | 72/368 |
| 1325320 | 8/1973 | United Kingdom | 72/398 |

*Primary Examiner*—Lowell A. Larson
*Attorney, Agent, or Firm*—Cushman, Darby & Cushman

[57] ABSTRACT

An anode cylinder of a magnetron is formed of a rectangular copper plate member. The plate member is curved in a rolling process to be formed into a cylindrical primary workpiece. In a first cold extrusion process, the primary workpiece is forced successively into a first die having an inner diameter shorter than the outer diameter of the primary workpiece and a second die having an inner diameter shorter than that of the first die and arranged in line with the first die. Thus, the primary workpiece is continuously reduced in its outer diameter to be formed into a secondary workpiece. The thickness reduction rate of the primary workpiece used during its passage through each of the first and second dies is limited to 3% or less. The secondary workpiece has its unnecessary portions removed in a cutting process and its seam filled up airtightly in an airtight bonding process.

9 Claims, 36 Drawing Figures

METHOD FOR MANUFACTURING ANODE CYLINDERS OF ELECTRON TUBES

This is a continuation of application Ser. No. 336,407, filed Dec. 31, 1981, abandoned.

BACKGROUND OF THE INVENTION

This invention relates to a method for manufacturing anode cylinders of electron tubes, such as transmitting tubes, magnetrons, X-ray tubes, klystrons, etc.

As is generally known, the anode of a magnetron for a microwave oven, for example, is formed of an anode cylinder, a plurality of anode vanes radially arranged on the inner face of the cylinder, and resonance cavities as many as the vanes. Available as the material for the anode are copper, aluminum, etc. which have high electric and thermal conductivity characteristics. In general, copper is preferred because of its higher heat resistance. In one conventional method for manufacturing the magnetic anode, an anode cylinder of a given length is cut from an elongated cylinder material, the inner and outer faces and both open end faces of the anode cylinder are cut into predetermined configurations, and anode vanes are brazed to the inner peripheral face of the cylinder. In another conventional method, a copper material is forced into a given die, and an anode cylinder and vanes are integrally extruded in a cold hobbing process. In the former method, however, the manufacture of the cylinder material requires much labor and costs a great deal to make the product expensive. Further, manufacturers of magnetrons will not be allowed freely to change the inner or outer diameter of the anode cylinder. In the latter method, on the other hand, a lot of trimmed material is cast away to reduce the coefficient of material utilization, and the die for the cold hobbing process is very susceptible to abrasion, resulting in an increase in manufacturing cost.

Accordingly, there has already been proposed a method for the manufacture of the magnetron anode in which an anode cylinder is formed by rolling up a plate piece or material and vanes are bonded to the inner face of the anode cylinder. This method facilitates the procurement and manufacture of material, and can enjoy redesigning of the cylinder, that is, change of the cylinder diameter and/or thickness. With this method, moreover, the coefficient of material utilization is approximately 100%. One such method for manufacturing an anode including the rolling process is disclosed in Japanese Utility Model Disclosures (KOKAI) Nos. 48-90464, 49-11659, 49-67545, 50-157854, 50-157855 and 51-121160, and U.S. Pat. No. 4,163,921.

Heretofore, however, the aforesaid method has not been put to practical use because it cannot fulfill the requirements of the magnetron anode. The electric properties of all resonance cavities including the resonance cavity corresponding to the airtight seam of the cylinder should be substantially the same. Therefore cylinders of satisfactory roundness and uniform circumferential wall thickness should be manufactured with high industrial reliability, and the seam between both end faces of the plate piece or material should entirely be closed over the whole length thereof with high accuracy to provide well-balanced airtightness thereat.

SUMMARY OF THE INVENTION

The object of this invention is to provide a method for manufacturing an anode cylinder of an electron tube having uniform thickness and substantially circular section, capable of exhibiting satisfactory electric properties when incorporated in the electron tube, and suited for mass production.

According to this invention, there is provided a method for manufacturing an anode cylinder of an electron tube by using a rectangular metal plate member with a given thickness. First, the metal plate member is curved to be formed into a substantially cylindrical primary workpiece with a certain outside diameter. Then, the primary workpiece is forced into a first die having an inner diameter shorter than the outer diameter of the primary workpiece to be reduced in outer diameter. Further, the primary workpiece with its outer diameter reduced is forced into a second die having an inner diameter shorter than that of the first die to be further reduced in outer diameter. After undergoing at least two outer diameter reduction steps, the primary workpiece has its seam entirely closed by its plastic deformation. The resultant workpiece is substantially circular in section.

Preferably, the thickness of the primary workpiece is reduced at a reduction rate of 3% or less in each of the first and second reduction steps. The first and second dies are arranged in succession so that the primary workpiece may continually pass through the first and second dies, and that the first and second reduction steps may be executed successively. After the first and second reduction steps, the thickness of the primary workpiece is preferably reduced at a reduction rate of 5% or less.

DETAILED DESCRIPTION OF THE PREFERRED EMBODIMENT

Figure 1:
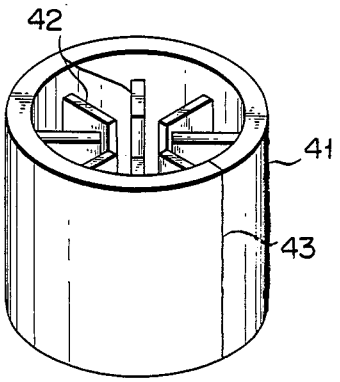
FIG. 1 is a perspective view showing an example of a magnetron anode manufactured by the method of this invention.
Figure 2:
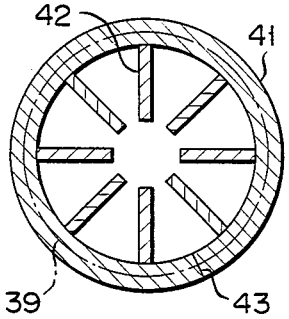
FIG. 2 is a cross-sectional view of the magnetron.

As shown in FIGS. 1 and 2, a magnetic anode manufactured by the method of this invention is formed by radially fixing a plurality of anode vanes 42 on the inner face of an anode cylinder 41 by brazing or other means. The cylinder 41 is formed of oxygen free copper or alloyed copper (hereinafter referred to simply as copper). A seam 43 between both end faces of the material of the cylinder 41 axially extending in parallel with each other is airtightly filled up by brazing or welding. Both inner and outer faces of the welded portion are formed smooth without projecting inward or outward. Further, the welded portion is so formed as to have a melting point high enough to stand the temperature to which it is exposed during the manufacture and operation of a magnetron, and to have airtightness to counter expansion and contraction or distortion caused by intermittent operations. These properties can be obtained because the closeness of the seam across the thickness of the cylinder material and along the axial direction thereof is uniform and perfect.

Figure 3:
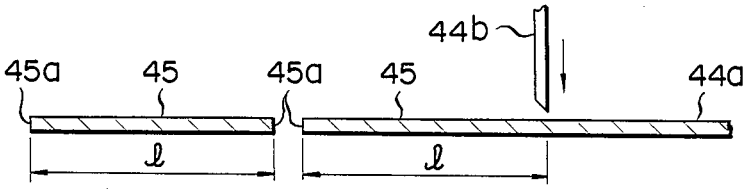
FIG. 3 is a sectional view showing a process for cutting an elongated cylinder material.
Figure 4:
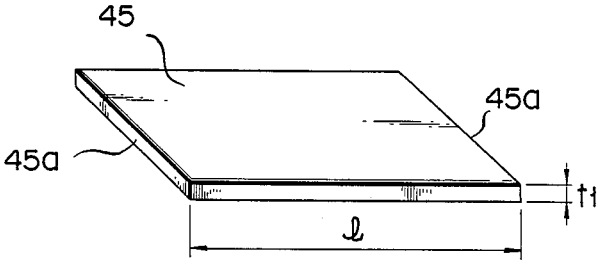
FIG. 4 is a perspective view of a plate piece.

As shown in FIGS. 3 and 4, the anode cylinder 41 is made of a plate piece 45 obtained by cutting an elongated copper sheet 44*a* to a given length l by means of a cutter 44*b*. The thickness t1 of the plate piece 45 is just a little greater than that of the anode cylinder 41 as a product. The length l is equal to or just a little greater than the circumferential length of a medial line 39 of the anode cylinder 41 as indicated by a chain line in FIG. 2. The plate piece 45 is rectangular in shape.

Figure 5:
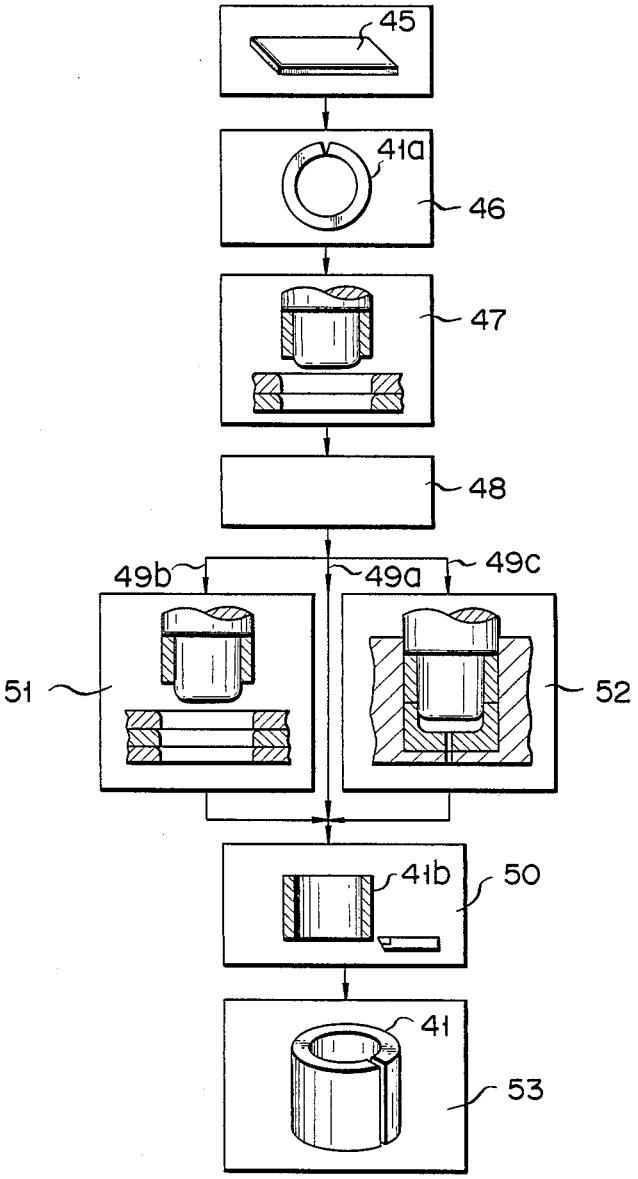
FIG. 5 is a schematic schedule diagram showing an embodiment of this invention.

The anode cylinder 41 is formed out of the plate piece 45 through several processes schematically shown in FIG. 5, and finally a magnetron anode is completed by fixing the vanes to the cylinder 41. Namely, a substantially cylindrical primary workpiece or initial cylinder is manufactured in a process 46 for rolling up the plate piece 45. In this stage, both end faces 45*a* of the material cannot come closely into contact with each other. After undergoing a first cold extrusion process 47, the initial cylinder is advanced to a process 48 for normal-temperature cooling. If the outside diameter of the initial cylinder is reduced for two or more steps (hereinafter referred to simply as reduction forming in some cases) to perfectly close the seam between the end faces 45*a* in the cold extrusion process, you can thereafter proceed along an arrow 49*a* to a process 50 for cutting the open end face and the inner and outer faces of the initial cylinder to your desired shaped and dimensions. Alternatively, as indicated by an arrow 49*b*, perfect closeness of the seam may be secured by reducing the outer diameter of the initial cylinder for two or more steps in a second cold extrusion process 51 before proceeding to the cutting process 50. As indicated by an arrow 49*c*, moreover, the cutting process 50 may be entered after a process 52 for axially compressing the initial cylinder. The process 52 covers both compression forming and extrusion forming. Thus, after the cold extrusion process for reducing the outside diameter of the initial cylinder for two or more steps, a secondary workpiece or intermediate cylinder is obtained. Slight undesirable flashes and the like, which may appear on the open end face of the intermediate cylinder, are removed in the cutting process 50, and the cylinder is worked into predetermined size and shape. After degreasing and cleaning, the two abutting end faces of the cylinder material are airtightly bonded together by brazing or welding in a process 53. Finally, at the same time with or after the airtight bonding process 53, a given number of anode vanes 42 are bonded and fixed to the inner circumferential surface of the anode cylinder 41 by brazing or the like, as shown in FIGS. 1 and 2. Thus, the magnetron anode is completed.

Figure 6A:
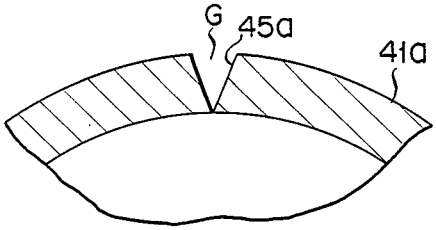
FIGS. 6A to 6D are partial cross-sectional views showing seams in various configurations.
Figure 6B:
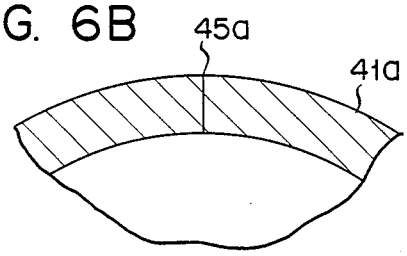
Figure 6C:
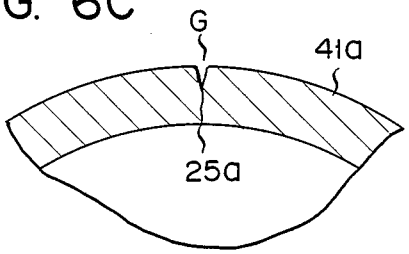
Figure 6D:
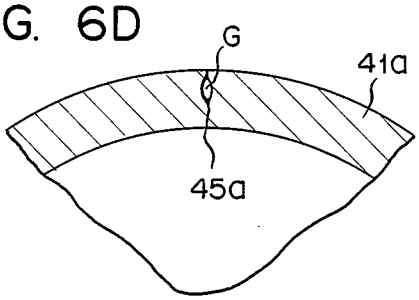

A method for manufacturing a cylindrical component by cold extrusion forming without spring-back is stated in Japanese Patent Disclosure No. 22477/80. In this method, the outer diameter of an initial cylinder to be extruded is reduced at one stroke for one step by using a single reducing die which is shorter than the axial length of the initial cylinder. It was found, however, that this method cannot directly be applied to the forming of such a cylinder as the magnetron anode cylinder that is made of relatively soft and thick material. As shown in FIG. 6A, a primary workpiece or initial cylinder formed by rolling up a copper plate piece inevitably involves a gap G opening at an angle of 10° to 30° at both end faces 45*a* of its material due to the great thickness of the material although the inner peripheral sides of the end faces 45*a* are closely in contact. The bevel gap G can be eliminated as shown in FIG. 6B by reducing the thickness of the cylinder material in an extrusion process. As a result, there may be obtained a seam of which edges are butted against each other in a radius direction and a longitudinal direction thereof. With the aforesaid prior art method, however, it was revealed that if the outer diameter of the initial cylinder is reduced for one step with use of a low thickness reduction rate for each diameter reduction process, it is impossible to obtain entire closeness of the seam on the outer peripheral side and the gap G will be left, as shown in FIG. 6C. If the outer diameter of the initial cylinder is reduced for one step with use of a high thickness reduction rate, however, an axially elongated, bulging gap G is liable to be left in a region extending from the middle of the thickness of the cylinder to the vicinity of the outer circumferential surface thereof although the end faces 45*a* of the cylinder material are in contact on the outer peripheral side, as shown in FIG. 6D. Thus, it is hard to obtain an entirely closed seam with high reliability. In the prior art method, moreover, it was found difficult to perform a forming process to cope with the requirements of the magnetron anode for satisfactory roundness and evenness in thickness.

According to this invention, therefore, the secondary workpiece or intermediate cylinder without the gap across the thickness of the cylinder material and over the whole axial length, as shown in FIG. 6B, may be formed by reducing the outer diameter of the initial cylinder with the thickness reduction rate for each step limited to 3% or less. Thus, the intermediate cylinder with satisfactory roundness and evenness in thickness is successfully obtained in the cold extrusion process including the two steps of reduction forming. In this invention, the reduction forming for two or more steps may be achieved by a method in which the outer diameter of the initial cylinder is reduced at a stroke for two or more steps in the first cold extrusion process 47 of FIG. 5. In this case, the thickness reduction rate for each of two reducing dies stacked in layers is limited to 3% or less. Alternatively, there may be used a method in which reduction forming for one step or two or more steps is performed in the first cold extrusion process 47, and then the second cold extrusion process 51 or the compression process 52 including second cold extrusion is performed. In this case, the thickness reduction rate used in the reduction forming in each of the first and second cold extrusion processes is limited to 3% or less. If the compression process 52 includes no cold extrusion, the foregoing first cold extrusion process 47 includes two or more steps of reduction forming. In this case, the thickness reduction rate for each step is limited to 3% or less.

Now the manufacturing processes will be described further in detail.

Figure 7:
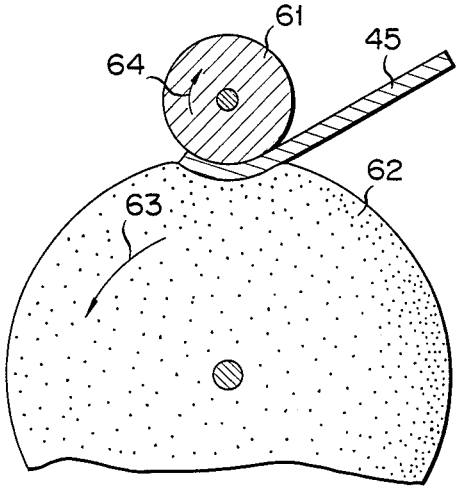
FIG. 7 is a schematic sectional view showing an example of a rolling process.
Figure 8:
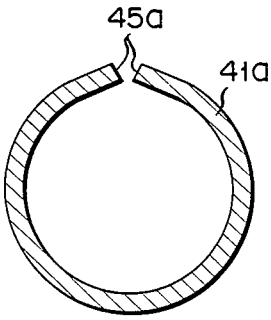
FIG. 8 is a cross-sectional view showing an example of a primary workpiece or initial cylinder formed in the process of FIG. 7.
Figure 9:
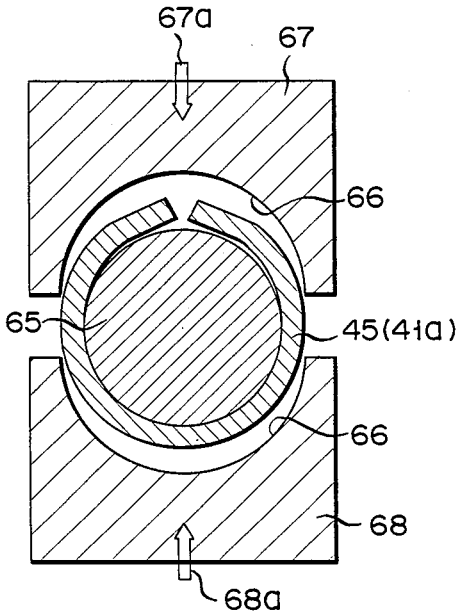
FIG. 9 is a cross-sectional view showing another example of the rolling process.
Figure 10:
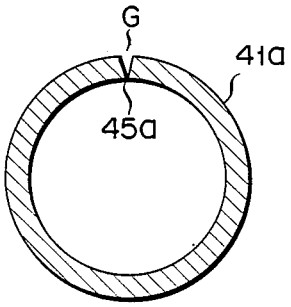
FIG. 10 is a cross-sectional view showing an example of a primary workpiece formed in the process of FIG. 9.

In the rolling process 46, the plate piece 45 is inserted between a core bar roller 61 and a circumferential roller 62 formed of a highly elastic material such as polyurethane rubber which, engaging each other under a pressure of scores of kilograms or more, constitute a rolling apparatus, as shown in FIG. 7. The proper Shore hardness of the circumferential roller 62 ranges from 80° to 95°. A driving force is applied to the circumferential roller 62 to rotate in the direction of an arrow 63. The core bar roller 61 is a hard metal structure with an outside diameter a little shorter than the inside diameter of the anode cylinder. The core bar roller 61, which is supplied with no driving force, can be rotated in the direction of an arrow 64 by a force transmitted from the circumferential roller 62. By this rolling process, the plate piece 45 is formed substantially cylindrical, as shown in FIG. 8. Both end portions of the cylindrical structure thus obtained are left straight. If a restrictive force is applied to the outer surface of the plate piece 45 so that the plate piece 45 may closely come into contact with the core bar roller 61 in the stage shown in FIG. 7 where the plate piece 45 is starting to be rolled on the outer circumferential surface of the core bar roller 61, the both end portions near the seam of the plate piece 45 can be formed rounder. Then, the plate piece 45 is shaped by a rolling apparatus shown in FIG. 9 to shape up the seam between the end faces and to improve the roundness of the resultant cylindrical structure. In this case, the cylindrical structure shown in FIG. 8 is put on the outer circumferential surface of a core bar 65, and two pressure blocks 67 and 68 each having a semicircular pressure surface 66 are pressed toward each other along a direction passing through the seam between the end faces 45*a* and the central axis of the core bar 65. In consequence, an initial cylinder 41*a* with improved roundness as shown in FIG. 10 can be obtained. Since there is hardly any extension attributable to plastic deformation on the outer circumferential surface of the material of the rounded initial cylinder 41*a*, a V-shaped gap G remains in the initial cylinder 41*a* even though the inner circumferential surface side of the end faces 45*a* are closely in contact with each other.

It is to be understood that the method for manufacturing the primary workpiece or initial cylinder according to the invention is not limited to the above-mentioned embodiment, and that the conventional method for rolling up a plate piece into the cylindrical structure as shown in FIG. 10 may also be employed.

Now the cold extrusion process 47 will be described in detail.

Figure 11:
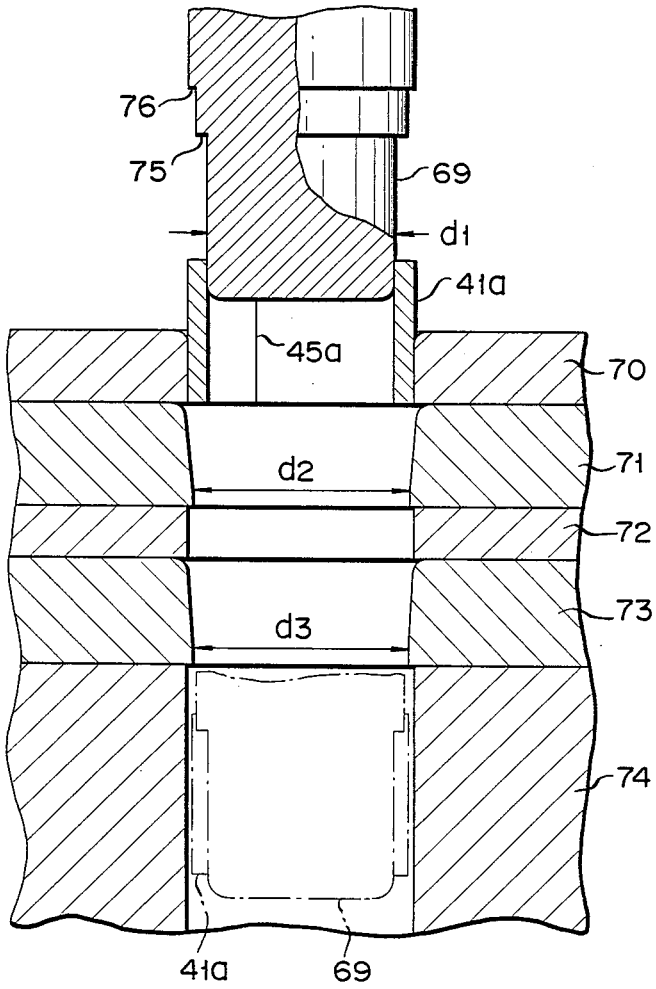
FIG. 11 is a profile showing an example of a cold extrusion process used in the invention.

In this process, for example, the outer diameter of the initial cylinder 41*a* is reduced at one stroke for two successive steps by means of a cold extrusion apparatus, as shown in FIG. 11. In this apparatus, a punch 69 is disposed at the upper portion of FIG. 11 so as to be able to move up and down, and a guide 70 for locating the initial cylinder 41*a* in place, a first reducing die 71, a guide spacer 72, a second reducing die 73, and a base 74 are stacked in layers at the lower portion. The outer diameter d1 of the punch 69 is substantially equal to the inner diameter of the anode cylinder, and the minimum inner diameter d3 of the second die 73 is shorter than the minimum inner diameter d2 of the first die 71. The differences between the minimum inner diameters d2 and d3 of the first and second dies 71 and 73 are so determined that the rate of thickness reduction of the initial cylinder 41*a* fitted on the punch 69 and passing through each die (ratio of thickness reduction after the passage through each die to the original thickness) is 3% or less. Preferably, the thickness reduction rates for the first and second reducing dies 71 and 73 are approximately 2% and 3%, respectively, and the total thickness reduction rate attained after the passage of the two dies 71 and 73 is approximately 5% or less. The punch 69 is provided with stopper portions 75 and 76. First, the initial cylinder 41*a* is set inside the guide 70, and then the punch 69 is lowered to be fitted in the initial cylinder 41*a*. As a result, the initial cylinder 41*a* is pushed by the stopper portion 75 to pass through the two reducing dies 71 and 73 in succession at one stroke. Thus, the cold-extruded cylinder 41*a* as indicated by broken lines is obtained. A small amount of material trimmed along the axial direction remains on that portion of the outer peripheral surface of the punch 69 which extends from the one stopper portion 75 to the other stopper portion 76.

Figure 12A:
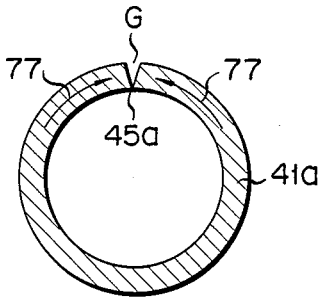
FIGS. 12A to 12C are cross-sectional views showing several examples of the cylinder shape obtained in the cold extrusion process.
Figure 12B:
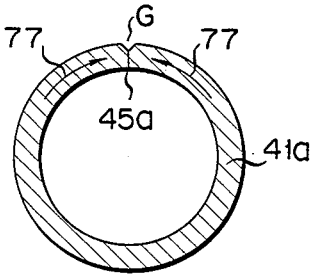
Figure 12C:
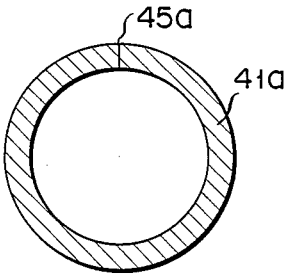

By such cold extrusion, the material of the initial cylinder 41*a* is caused to make a plastic flow from both sides as indicated by arrows 77 in FIG. 12A so that the V-shaped gap G at the seam between both end faces of the cylinder 41*a* may be gradually filled up. Then, as shown in FIG. 12B, the two end faces of the cylinder material are brought into contact from the inner circumferential surface side to the vicinity of the medial line along the circumference of the cylinder 41*a*. Finally, the end faces are entirely attached to each other over the whole axial length of the cylinder 41*a*, as well as across the thickness thereof, as shown in FIG. 12C. Moreover, plastic deformation is caused to prohibit a spring-back force from being produced.

In the cold extrusion process, the workpiece is subjected to a high temperature of scores of degrees centigrade, so that the process 48 for cooling the workpiece to a temperature in the vicinity of room temperature by oil cooling or natural cooling is performed before the subsequent processes.

If the gap G remains in some measure at the seam or a spring-back force is produced to create the gap G, as shown in FIG. 12B, whether the first cold extrusion process 47 includes the one-stroke, one-step reduction forming or one-stroke, multi-step reduction forming, the cold extrusion process 51 or the compression process 52 is performed subsequently.

Figure 13:
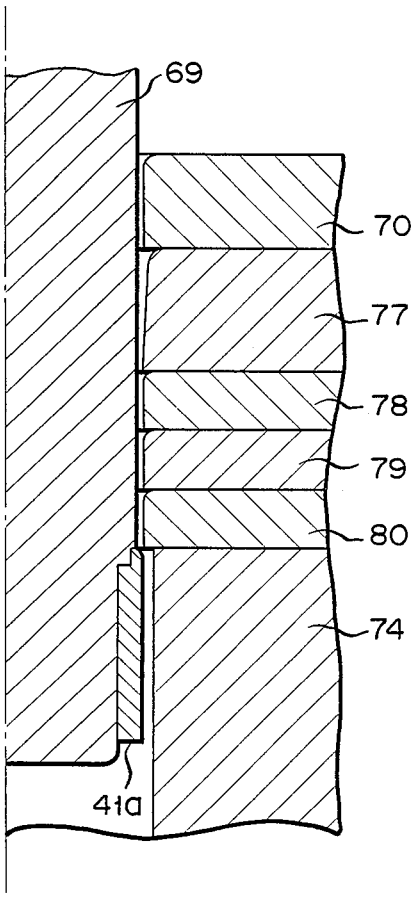
FIG. 13 is a half profile showing another example of the cold extrusion process used in the invention.

Now the second extrusion process 51 will be described in detail. This process may include one-stroke, one-step reduction forming or two-step reduction forming as shown in FIG. 11. As shown in FIG. 13, moreover, the outer diameter of the cylinder may be reduced at one stroke for four successive steps. Also in this case, it is essential to limit the thickness reduction rate for each step to 3% or less.

In FIG. 13, first to fourth reducing dies 77, 78, 79 and 80 with their minimum inner diameters decreasing in order are stacked in close layers under the guide 70. The state of FIG. 13 is a state obtained after the outer diameter of the initial cylinder 41*a* is reduced at one stroke for four successive steps. Thus, the seam between both end faces of the cylinder material may entirely be closed with improved reliability to provide a spring-back-free anode cylinder. Preferably, the thickness reduction rate of each of the reducing dies 77 to 80 is limited to 2% or less.

Figure 14:
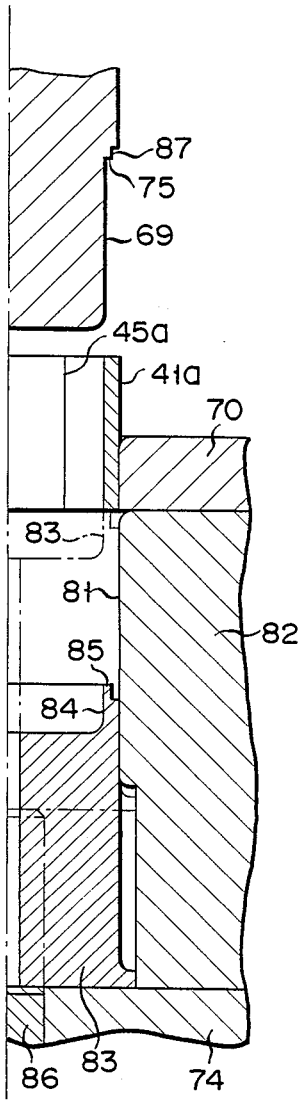
FIGS. 14 and 15 are half profiles showing an example of a compression process used in the invention.
Figure 15:
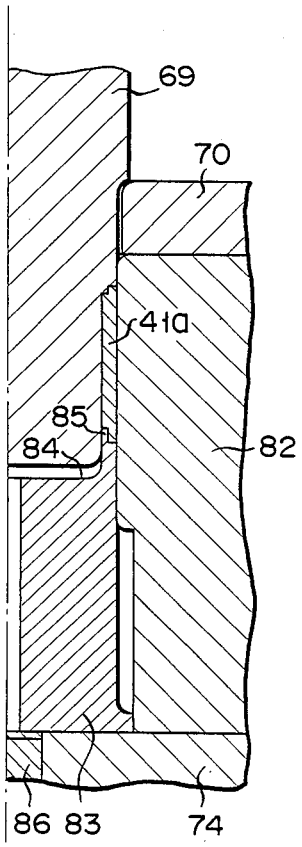

In the compression process 52, as shown in FIGS. 14 and 15, the initial cylinder 41*a* is subjected to an axial compressive force for plastic deformation. Thus, the two end faces of the cylinder material are brought closely in contact and the spring-back force is checked. In this process, reduction forming and shaping of the open end face of the anode cylinder can be performed at the same time. FIGS. 14 and 15 show the state of a compression apparatus immediately before and after the forming, respectively. This apparatus includes an elongated die 82 with a reducing die portion 81 under the guide 70, and a die-and-knockout 83 disposed inside the lower portion of the die 82. The die-and-knockout 83 includes a top receiving portion 84 in which the tip end of the punch 69 is tightly fitted, and an outer peripheral edge 85 of desired configuration for shaping the open end face of the anode cylinder, and serves also as a knockout to push out the intermediate cylinder 41*b* upward by means of a force cylinder 86 after the forming. The punch 69 is provided with a stepped portion 87 for shaping the open end face of the anode cylinder. The stepped portion 87 serves also as a space to absorb surplus material.

Fitted on the punch 69, the initial cylinder or primary workpiece 41*a* is lowered, reduced in outside diameter by the reducing die portion 81, and subjected to an axial compressive force with one and the other open end portions thereof restricted by the stopper portion 75 of the punch 69 and the outer peripheral edge 85 of the die-and-knockout 83, respectively. The compressive force causes such a plastic flow in the workpiece that the gap G at the seam may be filled up in the same manner as indicated by arrows 97 in FIGS. 12A and 12B. Thus, the seam between both end faces of the cylinder material is sure to be entirely closed, and the two open ends of the cylinder can simultaneously be formed into desired shapes or shapes approximate thereto. Since the spring-back force can be checked, moreover, the seam of the intermediate cylinder or secondary workpiece 41*b* obtained will never be opened. Naturally, it is necessary to determine the stroke of the punch 69 and the positional relationship between the punch 69 and the die-and-knockout 83 so that the axial dimension of the workpiece may correspond to the size of the anode cylinder as a product, and that the amount of material bulging out may be minimized.

Figure 16:
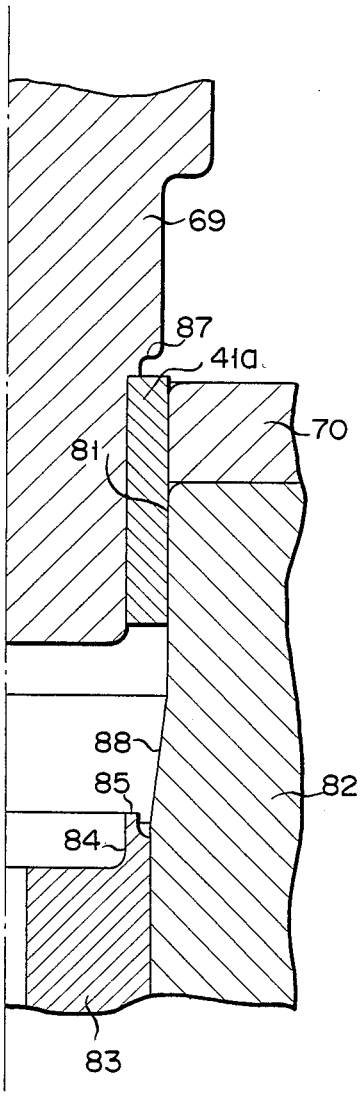
FIGS. 16 and 17 are half profiles showing another example of the compression process.
Figure 17:
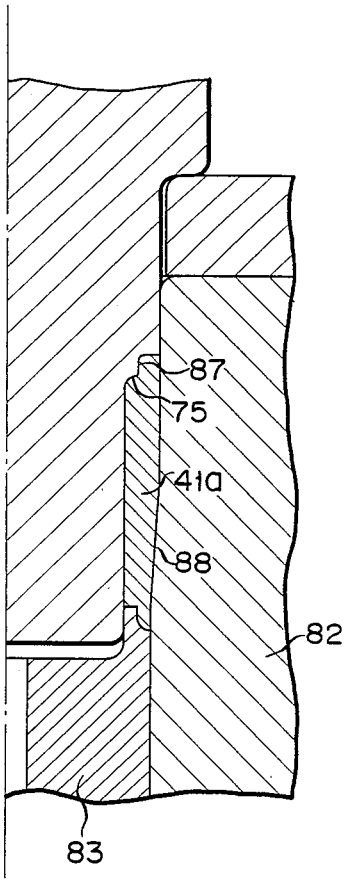

In some cases, the magnetron anode cylinder may have a taper surface formed on the inner circumferential surface as well as on the open end portion for the ease of insertion and brazing of vanes, or a taper surface formed on the outer circumferential surface for the ease of force fit and fixing of a radiator. It is therefore advisable to form the taper surfaces on the inner and outer circumferential surfaces at the same time in the cold extrusion process or the compression process. Namely, the taper surfaces may simultaneously be formed on the workpiece by subjecting the workpiece to the reduction or compression forming with use of the die 82 having a taper portion 88 previously formed thereon, as shown in FIGS. 16 and 17. Sharing the reduction function with the reducing die portion 81, the taper portion 88 can contribute to the improvement of the closeness of the seam between both end faces of the cylinder material. Alternatively, the taper portion may be formed on the outer circumferential surface of the punch 69. In these cases, the taper portion need have such a tendency that the thickness of the workpiece may be reduced by the reduction or compression forming. Otherwise, the seam between the end faces of the cylinder material will undesirably be opened to create a partial or entire gap.

It is essential to execute the above-mentioned second cold extrusion process 51 or compression process 52 after the initial cylinder formed in the first cold extrusion process 47 is cooled to room temperature in the cooling process 48. By the cooling process 48, the thickness reduction rate can properly be controlled to ensure high-accuracy, high-stability continuous forming operation without regard to the variations of the kinds of material used.

Anode cylinders obtained in this way can be manufactured as products with uniform properties; the out of roundness (ratio (D1−D2)/D3 of the difference (D1−D2) between the maximum diameter (D1) and minimum diameter (D2) of the outer circumference of the cylinder to the average diameter (D3)) of 0.15% or less, the circumferential thickness deviation rate (ratio (t5−t6)/t7 of the thickness deviation (t5−t6) or the difference between the maximum thickness (t5) and minimum thickness (t6) to the average thickness (t7)) of 2% or less, and the gap width of the seam between both end faces of the cylinder material of 0.15 mm or less.

Figure 18:
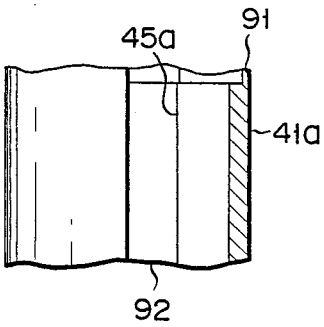
FIGS. 18 and 19 are half profiles showing examples of an intermediate cylinder formed in the cold extrusion process.
Figure 19:
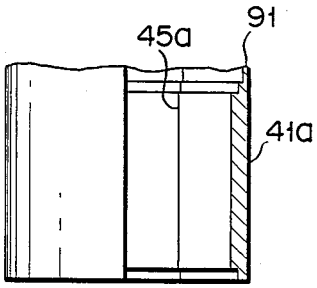
Figure 20:
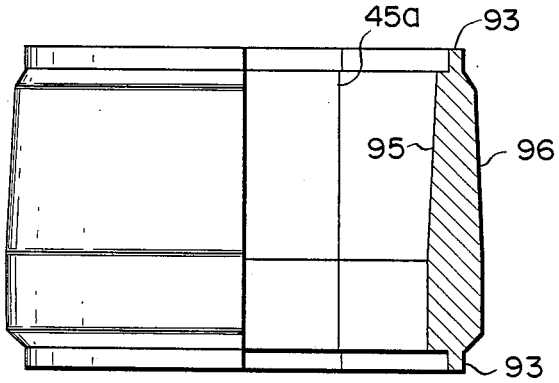
FIG. 20 is a half sectional view of an anode cylinder cut in a desired manner.

As shown in FIG. 18 or 19, the secondary workpiece 41*b* passed through the cold extrusion process 47 or the processes 51 and 52 is accompanied with slight flashes 91 or rugged faces 92 formed of surplus on one or both open end faces thereof. Accordingly, it is necessary to cut off these undesirable portions to form end configurations 93 and 94 essential to the anode cylinder and, if needed, taper surfaces 95 and 96 on the inner and outer circumferential surfaces, as shown in FIG. 20, for example.

The cutting process 50 is provided for this purpose. In the anode cylinder obtained with use of the aforementioned rolling and reduction forming processes, both end faces of its material abut each other only naturally. Therefore, careless machine work will cause a difference in level at the seam portion or undesirably open the seam, thereby complicating satisfactory high-accuracy cutting work.

Figure 21:
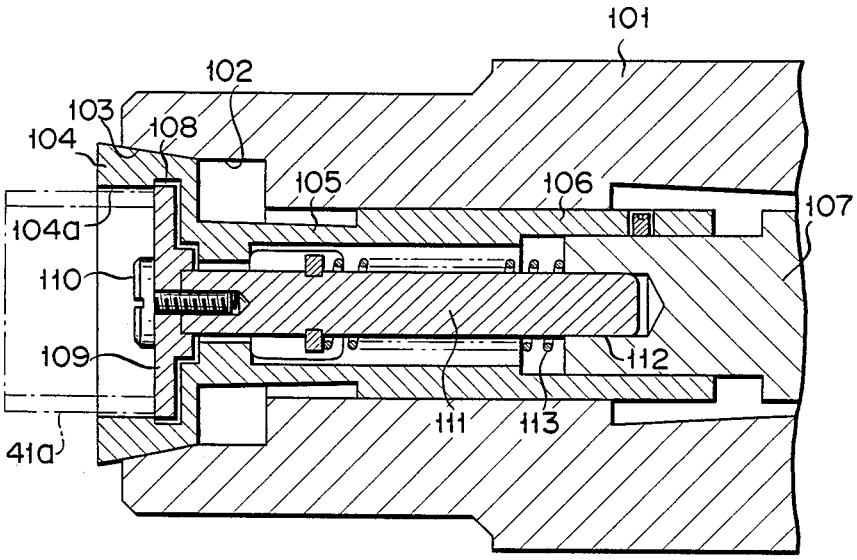
FIGS. 21 and 22 are partial profiles showing an example of a cutting process used in the invention.

Thereupon, the inventors hereof found that the aforesaid difficulties can be removed by pressing only the outer circumference of the anode cylinder at a fixed pressure by means of a chuck and subjecting the cylinder to cutting work along the circumferential direction while rotating the cylinder at high speed, as shown in FIGS. 21 to 24. In a cutting apparatus shown in FIGS. 21 to 24, a recess portion 102 is defined inside the forward end of a cylindrical holder 101 formed of rigid material, and a taper surface 103 extended from the recess portion 102 to the forward end face of the holder 101 so that the inside diameter of a space defined by the taper surface 103 gradually increases toward the forward end face. The taper surface 103 is slidably fitted on the outer circumferential taper surface of a chuck 104. The chuck 104 is divided into three pieces so that the workpiece 41*a* may be fixed by chuck surfaces 104*a* or the inner peripheral surfaces of these three pieces. A middle portion 105 of the chuck 104 is elastic enough to spread out, and a cylindrical end portion 106 on the right-hand side of FIG. 21 is fixed to a movable cylinder 107 by means of a screw or the like. A recess 108 somewhat increased in diameter is defined inside the chuck 104. Fitted in the recess 108 is a discoid receiving plate 109 on which one end face of the initial cylinder 41*a* abuts. The receiving plate 109 is fixed by means of a screw 110 to one end portion of a center rod 111 which is inserted in the cylindrical middle portion 105 of the chuck 104. The other end portion of the center rod 111 is slidably inserted in a bore 112 in the movable cylinder 107, and is always urged to be pushed out or moved away from the movable cylinder to the left of FIG. 21 by a spring 113 which tends elastically to extend in the longitudinal direction thereof. Thus, the chuck 104 and the movable cylinder 107 can be moved in the longitudinal direction as against the holder 101 by means of a piston mechanism (not shown) of the cylinder 107. Capable of longitudinally moving together with the chuck 104 and the cylinder 107, the receiving plate 109 is pushed by the spring 113 to be always in contact with the side face of the recess 108. The whole structure including all these mechanisms can rotate at high speed.

Figure 22:
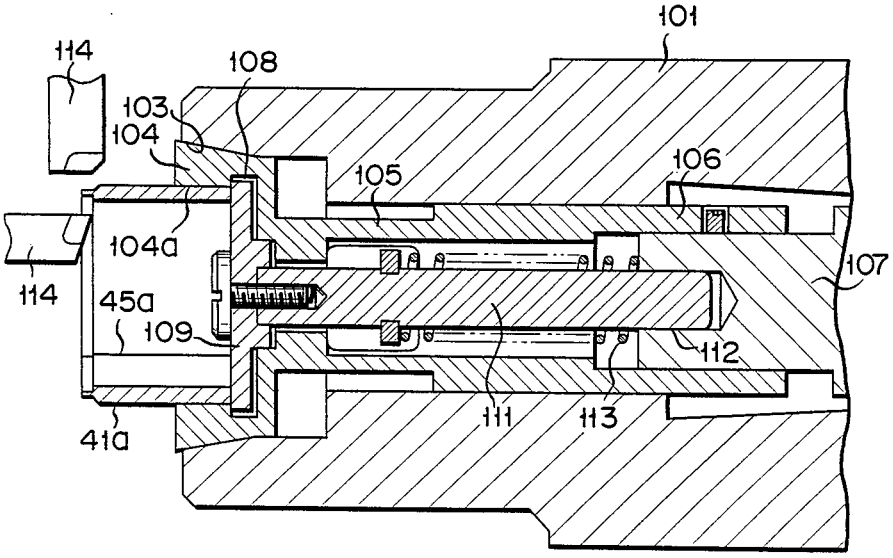
Figure 23:
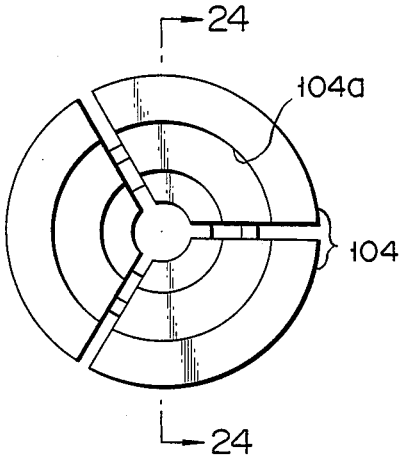
FIGS. 23 and 24 are side and sectional views of a cutting apparatus used in the cutting process of FIGS. 21 and 22, respectively.
Figure 24:
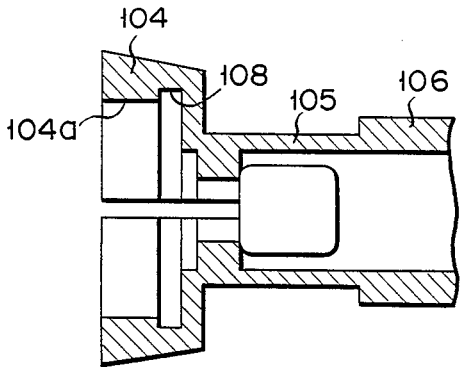

Now the operation of the cutting apparatus will be described. FIG. 21 shows a state of the apparatus immediately before the workpiece 41*a* is set therein. First, the movable cylinder 107 is pushed out to the left, the chuck 104 is slidden along the taper surface to be spread out, and the workpiece 41*a* is inserted until one end face thereof abuts on the receiving plate 109 as indicated by chain lines in FIG. 21. After the insertion, the movable cylinder 107 is pulled back to the right to cause the chuck surfaces 104*a* of the chuck 104 to abut on the outer circumferential surface of the workpiece so that the workpiece is exactly concentrically held by a cylindrical surface formed of the three chuck surfaces 104*a*. If the one end face of the workpiece 41*a* is not perpendicular to the receiving plate 109, only the foremost part of the end face abuts on the receiving plate 109. Thus, the respective central axes of the workpiece 41*a* and the apparatus are securely aligned by the chuck surfaces 104*a*. The force of the chuck 104 to push the workpiece 41*a* from the outside can be controlled by controlling the tractive force of the movable cylinder 107. After the workpiece 41*a* is fixed in this manner, the apparatus is rotated at high speed, and a cutting tool 114 is held against the workpiece 41*a* to cut it into a desired shape, as shown in FIG. 22.

According to the aforesaid cutting method and apparatus, the cylindrical workpiece to be cut or the anode cylinder with a seam is pressed and fixed by the chuck only from its outer circumferential surface when it is cut, so that the fixing pressure on the workpiece can be kept constant, and high-accuracy, stable cutting work can be achieved without any distortion of the workpiece or opened seam. If neither of the open end faces of the workpiece can serve as a datum plane, one of the end faces is first cut by means of the cutting apparatus. Then, the one end face, thus finished into a surface exactly perpendicular to the axis of the workpiece, is caused to abut on the receiving plate 109. Since the receiving plate 109 is always pressed against the side face of the recess 108 of the chuck 104, the axial dimension for cutting can be set on the basis of such side face.

Thus, the cylindrical workpiece or anode cylinder with the axial seam produced by the rolling work can uniformly be cut throughout the circumference thereof including the seam portion without undesirably opening or crushing the seam.

The cutting work may be performed after the seam is closed by brazing or welding. In this case, however, the number of processes will be increased, or undesired projections will be formed on the outer circumferential surface of the workpiece, or there will be variations in the kinds or crystal structure of material at the seam portion. Thus, it is difficult to achieve high-accuracy, uniform cutting work. For simplified processes as well as improved accuracy, therefore, it is advisable to proceed directly to the cutting process after the seam is closed in the rolling process, as in the method of the invention.

Figure 25:
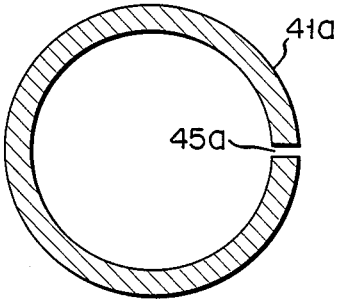
FIG. 25 is a cross-sectional view showing a state in which the seam of the anode cylinder is cleaned.
Figure 26:
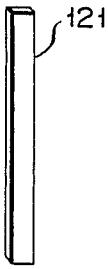
FIG. 26 is a perspective view of a brazing material.
Figure 27:
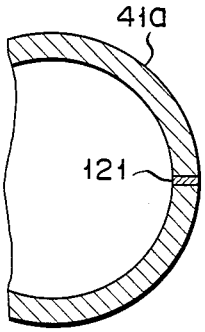
FIG. 27 is a partial sectional view showing a state of the anode cylinder before brazing.

The secondary workpiece 41*a* for the anode cylinder formed in the aforementioned manner is then transferred to the airtight bonding process. In the bonding process, the seam 45*a* may be filled up by brazing or welding. In either case, the seam is once opened a little for degreasing, as shown in FIG. 25, cleaned by spraying a quick-drying solvent or the like, and dried. In brazing, for example, a brazing filler metal sheet 121 with a thickness of 0.1 to 0.2 mm as shown in FIG. 26 is inserted in the seam, as shown in FIG. 26 is inserted in the seam, as shown in FIG. 27, and a compressive force is externally applied to the workpiece at a point of time when the brazing material is melted by a brazing tool (not shown). Thus, the seam can satisfactorily be filled up throughout the length and breadth thereof by bubble-free or airtight brazing without causing any substantial change in diameter of the workpiece.

If the gap G as shown in FIG. 6C or 6D remains at the seam, air bubbles or brazing material may be collected in the gap G to prevent the entire, uniform brazing. The closeness of the seam is quite essential for this reason. Thus, the anode cylinder 41 of the magnetron is completed. At the same time with or after the seam brazing, the anode vanes are fixed to the inside wall of the cylinder by brazing or the like to complete the magnetron anode as shown in FIGS. 1 and 2.

In manufacturing the anode cylinder by rolling up the copper plate piece 45 and reduction-forming the resultant workpiece, as in the above-mentioned embodiment of the invention, high accuracy and reliability may be ensured by the use of a material with Vickers hardness of 70 to 95 for the plate piece 45.

In the rolling work and reduction forming, as described above, it is necessary that the cut faces of the plate piece be subject to less shear droop, that the seam between both end faces of the material after the rolling work be not opened too wide, and that a moderate circumferential plastic flow be caused in the reduction forming to prevent a gap from being created at the seam. Moreover, it is necessary that the rolling work and reduction forming do not require excessive forming force or pressure, and that the cutting of the open end faces be able to be performed with high accuracy. After various examinations, it was found that materials with hardness within the aforesaid range can fulfill those several requirements, and can most suitably be used.

Now there will be described the results of various examinations on the manufacture of an anode for a magnetron made of oxygen free copper and rated for hundreds of watts to several kilowatts at frequencies of 2,450 MHz and 915 MHz.

First, it was confirmed that the rate of elongation of the material 45, whether axial or circumferential, need be not less than 15% in order to avoid cracking in the rolling work and reduction forming. This elongation rate is a value based on a tension test stated in JIS-Z2241 and 2201.

Figure 28:
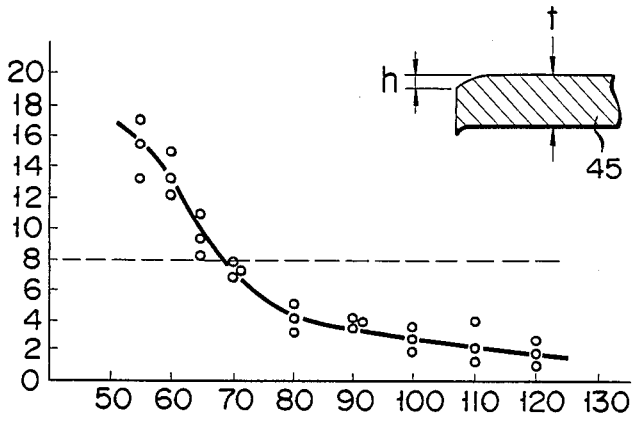
FIGS. 28 to 30 show characteristic curves illustrative of the relationships between resultant forming conditions and the hardness of various materials.

The hardness of the material 45 has an expressly great influence on the conditions of cut faces obtained when the elongated material is cut into the given length, as shown in FIG. 3. Thereupon, the conditions of the cut faces were measured with varied values of Vickers hardness for a manufacturing method in which the elongated material is restricted from both top and under surfaces thereof when it is cut, and the cut faces are used directly as the end faces to define the seam of the anode cylinder to minimize material loss. FIG. 28 shows the results of such measurement. In this graph, the axes of abscissa and ordinate represent the Vickers hardness of material and the ratio (h/t) of the degree of shear droop (h) to the plate thickness (t), respectively. If the degree of shear droop exceeds approximately 8%, the closeness of the seam between the end faces will be deteriorated to leave the gap G as shown in FIG. 6C on the inner or outer circumferential side of the cylinder. If the reduction forming and compression forming are repeated until the gap G is entirely filled up, the predetermined wall thickness of the anode cylinder will not be able to be maintained. From this point of view, it was confirmed that the Vickers hardness of material should preferably be approximately 70 or more.

The Vickers hardness, which is based on a test stated in JIS-Z2244, is a value which is obtained by dividing a load, which is applied to a subject surface when the surface is pyramidally indented by using a pressure body or a quadrangular pyramid of diamond with facing angle of 136°, by the surface area of the pyramid calculated on the basis of the length of the diagonal of a permanent dent. The Vickers hardness may be calculated as follows:

$$Hv = \frac{2P\sin\frac{\alpha}{2}}{d^2}.$$

Here,

Hv: Vickers hardness (kg/mm$^2$),

P: load (kg), d: average length of diagonal of dent (mm)

$\alpha$: facing angle.

Figure 29:
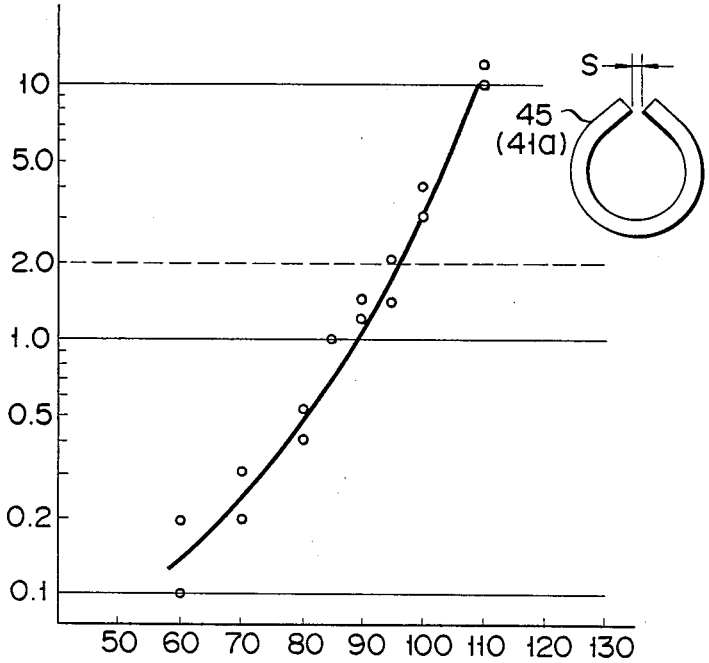

The hardness of material also has an influence on the groove size S of the seam between both end faces of the material provided by a spring-back force produced after the rolling work. Materials with different Vickers numbers were rolled up by the rolling apparatus shown in FIG. 7, with the dimensions, elasticity and rolling pressure of the core bar roller and circumferential roller fixed, and the groove sizes S obtained thereby were measured. FIG. 29 shows the results of such measurement. As is evident from FIG. 29, the groove size S increases substantially exponentially with the increase of the hardness of material. In the case of FIG. 29, the outer diameter and plate thickness are approximately 44 mm and 2.5 mm, respectively. If the groove size S exceeds approximately 2 mm, it will become difficult to reduce the groove size to improve the roundness of the cylinder in the shaping process of FIG. 9 due to the spring-back effect. In this case, moreover, the spring-back force will not be able to be checked in the reduction forming, or an additional number of processes will be required for the insertion of the cylinder in the reducing die. Thus, there will be required an additional process for rerolling. Accordingly, the Vickers hardness of material should preferably be approximately 95 or less.

Figure 30:
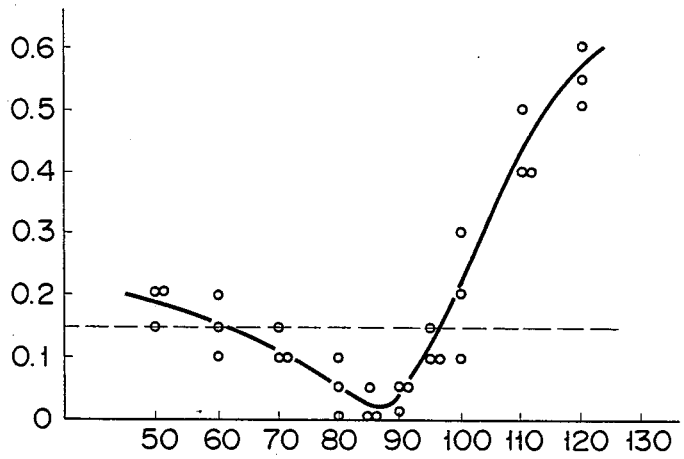
Figure 31:
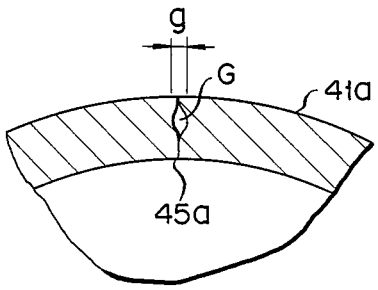
FIG. 31 is a sectional view for illustrating the clearance of a seam shown in FIG. 30.

In connection with this, FIGS. 30 and 31 show the results of measurements of the width g of the gap G created at the seam between both end faces of the anode cylinder material after the reduction forming, using materials with various Vickers numbers. It was found that if the Vickers hardness is too high, the closeness of the seam will not be entire, leaving a wide gap. If the hardness is too low, on the other hand, the axial material flow will become too large to secure sufficient circumferential flow, so that the gap G at the seam will not be able to be filled up. Preferably, the width g of the gap G should be limited to 0.15 mm or less for the reliability and ease of the cutting and airtight brazing processes. Thus, the proper or practical Vickers hardness of material was found to range from approximately 70 to 95.

Although an illustrative embodiment of the method for manufacturing anode cylinders of magnetrons of this invention has been described in detail herein with reference to the accompanying drawings, it is to be understood that the invention is not limited to the anode cylinders of magnetrons, and may also be applied to the anode cylinders of a wide variety of electron tubes, such as e.g. transmitting tubes, X-ray tubes, klystrons, etc.

What we claim is:

1. A method for manufacturing an anode cylinder of a magnetron comprising the sequential steps of:

(a) curving a rectangular copper plate member having opposing end faces and a given thickness to form a substantially cylindrical primary workpiece of a predetermined outer diameter and a seam, said seam having a gap defined between the opposing end faces of the curved plate member;

(b) forcing said cylindrical primary workpiece in a first reduction step, into and through at least one first reduction die of the type having an inner diameter less than the diameter of said primary workpiece to reduce the outer diameter of said primary workpiece to thus reduce the defined gap;

(c) cooling said primary workpiece; and (d) forcing, during a second reduction step, said primary workpiece into a second reduction die having an inner diameter less than the outer diameter of said primary workpiece to form a secondary workpiece with a diameter less than the diameter of said primary workpiece achieved during said first reduction step, said second reduction step including the steps of (i) fitting the primary workpiece on a punch and die-and-knockout assembly, (ii) pushing the primary workpiece into the second reduction die by the punch to reduce the diameter of the primary workpiece, and (iii) applying a compressive force, in axial alignment with said seam, to said primary workpiece by relative closing movement between said punch and die-and-knockout assembly, said axial compression force causing metal flow to be created thereby removing the defined gap and closing the seam; and (e) sealing the closed seam of the secondary workpiece to form the anode cylinder.

2. A method according to claim 1, wherein the Vickers hardness of said plate member ranges from 70 to 95.

3. A method according to claim 1, wherein the elongation percentage of said plate member is not less than 15%.

4. A method according to claim 1, wherein the thickness of said primary workpiece is reduced at a reduction rate of 3% or less by each of said first and second dies, and is reduced at a total reduction rate of 5% or less in said first reduction step.

5. A method according to claim 1, wherein the thickness of said primary workpiece is reduced at a reduction rate of 3% or less by said second reduction die in said second reduction step.

6. A method according to claim 1, further comprising a step of cutting the open end face of said cylindrical secondary workpiece.

7. A method according to claim 1, wherein said first reduction step includes the step of forcing said cylindrical primary workpiece into and through a first main reducing die and then through an additional reduction die, thereby continuously reducing the outer diameter of said primary workpiece, the additional reduction die having an inner diameter less than the diameter of the first main reduction die.

8. A method according to claim 1, wherein step (e) includes the steps of opening the closed seam of the secondary workpiece, inserting a brazing filler metal sheet in the seam, and melting the brazing filler metal sheet to bond the opposing end faces defining the seam of secondary workpiece.

9. A method according to claim 1, wherein said second reduction step further includes a step of forming a taper surface on said secondary workpiece.

* * * * *

UNITED STATES PATENT AND TRADEMARK OFFICE

CERTIFICATE OF CORRECTION

PATENT NO. : 4,570,843

DATED : Feb. 18, 1986

INVENTOR(S) : Hikaru MATSUZAKI, Toshiyuki MATSUZAKI

It is certified that error appears in the above—identified patent and that said Letters Patent is hereby corrected as shown below:

ON THE FIRST INFORMATION PAGE:

Change "[73] Assignee: Tokyo Shibaura Denki Kabushiki Kaisha, Japan" to --[73] Assignee: Tokyo Shibaura Denki Kabushiki Kaisha, Kawasaki, Japan--.

Signed and Sealed this

Sixteenth Day of December, 1986

*Attest:*

DONALD J. QUIGG

*Attesting Officer* *Commissioner of Patents and Trademarks*